US006357439B1

(12) United States Patent
Cook et al.

(10) Patent No.: US 6,357,439 B1
(45) Date of Patent: Mar. 19, 2002

(54) GAS CONTAINMENT APPARATUS

(75) Inventors: John Cook, Farnborough; Brian J Richards, Storrington, both of (GB)

(73) Assignee: The Secretary of State for Defence in Her Britannic Majesty's Government of theUnited Kingdom of Great Britain and Northern Ireland, Farnborough (GB)

( * ) Notice: Subject to any disclaimer, the term of this patent is extended or adjusted under 35 U.S.C. 154(b) by 0 days.

(21) Appl. No.: 09/043,292

(22) PCT Filed: Sep. 25, 1996

(86) PCT No.: PCT/GB96/02367

§ 371 Date: Mar. 24, 1998

§ 102(e) Date: Mar. 24, 1998

(87) PCT Pub. No.: WO97/12175

PCT Pub. Date: Apr. 3, 1997

(30) Foreign Application Priority Data

Sep. 25, 1995 (GB) ..... 9519503
Nov. 10, 1995 (GB) ..... 9523089

(51) Int. Cl.[7] ..... A62B 7/00

(52) U.S. Cl. ..... 128/205.22; 128/200.24; 220/646; 220/648

(58) Field of Search ..... 128/205.12, 205.13, 128/205.17, 205.22, 205.25; 220/589, 590, 588, 597, 566, 645, 646, 648

(56) References Cited

U.S. PATENT DOCUMENTS 1,608,264 A * 11/1926 Figlietti ..... 128/205.22
2,844,145 A * 7/1958 Berge ..... 128/205.12
3,184,092 A * 5/1965 George ..... 220/566
3,949,894 A * 4/1976 Underwood ..... 220/63
4,005,233 A * 1/1977 Dritt et al. ..... 428/35
4,073,400 A * 2/1978 Brook et al. ..... 220/63
4,369,894 A * 1/1983 Grover et al. ..... 220/414
4,428,998 A * 1/1984 Hawkinson ..... 428/240
4,438,858 A * 3/1984 Grover ..... 220/3
4,475,662 A * 10/1984 Mandel ..... 220/589
4,582,211 A * 4/1986 Mandel ..... 220/589
4,699,288 A * 10/1987 Mohan ..... 220/589
4,767,017 A * 8/1988 Logullo, Sr. et al. ..... 220/3
4,804,427 A * 2/1989 Paul et al. ..... 156/181
4,854,988 A * 8/1989 Voirol et al. ..... 156/155
4,921,557 A * 5/1990 Nakamura ..... 156/169
4,927,038 A * 5/1990 Roebuck ..... 220/3
5,036,845 A * 8/1991 Scholley ..... 128/205.22
5,127,399 A * 7/1992 Scholley ..... 128/205.22
5,197,628 A * 3/1993 Phan et al. ..... 220/589
5,211,306 A * 5/1993 Delonge-Immik et al. .. 220/589
5,284,996 A * 2/1994 Vickers ..... 588/249
5,494,188 A * 2/1996 Sirosh ..... 220/589
5,518,141 A * 5/1996 Newhouse et al. ..... 220/589
5,647,503 A * 7/1997 Steele et al. ..... 220/589
5,681,010 A * 10/1997 Jensen ..... 244/49
5,725,709 A * 3/1998 Jensen ..... 156/169
5,766,534 A * 6/1998 White et al. ..... 264/258

FOREIGN PATENT DOCUMENTS

DE C 971 689 6/1956
DE C 33 16 539 4/1984
GB A 1 061 596 3/1967
GB A 2 110 566 6/1983

* cited by examiner

*Primary Examiner*—John G. Weiss
*Assistant Examiner*—Joe Weiss
(74) *Attorney, Agent, or Firm*—Nixon & Vanderhye P.C.

(57) ABSTRACT

A gas containment and supply apparatus is described consisting of a gas reservoir vessel (1) capable of pressurised gas containment fitted with a gas supply aperture (8) provided with supply means connectable to the gas supply aperture to provide for supply of the gas and control means to control the rate of supply of the gas, in which the gas reservoir is a toroidal pressure vessel comprising a metallic toroidal shell (2) having wound on its surface a tensile load bearing layer of high tensile strength non-metallic fiber (4), the fiber being aligned in a substantially meridional direction on the toroidal shell. Human portable breathing apparatus is described utilising the above.

28 Claims, 4 Drawing Sheets

(a)

(b)

GAS CONTAINMENT APPARATUS

BACKGROUND OF THE INVENTION

1. Field of the Invention

The invention relates to a compact gas containment and supply apparatus, particularly one which is readily human portable 2. Discussion of Prior Art To enhance portability of pressurised gas containment vessels there is a general requirement for high strength combined with relatively low weight. Overwinding around an internal shell is a well established technique both for strength and for weight reduction in the manufacture of cylindrical pressure vessels, such as gun barrels, gas cylinders and the like. Such structures when pressurized are subjected to hoop stresses that are significantly higher than the axial stresses, and the use of an overwinding designed to carry a large part of the hoop load allows the design of the base cylinder to be directed towards meeting only the axial stresses, with a considerable potential for saving in weight. Traditionally such windings were of high tensile strength metal wires. Recent developments in composite material technology have led to the use of composites consisting of fibre windings in a resin matrix.

Toroidal pressure vessels offer an alternative geometry to cylinders. Toroidal vessels comprised of a metal or composite inner toroidal casing overwound with wire or resin matrix fibre composite material are known and are described for example in UK Patent Application 2110566. These can offer some reduction of weight over unwound toroidal shell structures. In the case of composite winding, manufacturing can be complex as conventional winding equipment does not readily allow for the application of resin bonding during winding. It proves difficult to ensure complete wetting of fibre by matrix resin and incompletely wetted fibres constitute zones of weakness in conventional resin matrix fibre composite structures.

SUMMARY OF THE INVENTION

An object of the present invention is to provide a lightweight and compact gas containment and supply apparatus based on a toroidal pressure vessel having fibre overwinding with a reduced weight, and which mitigates some of the manufacturing difficulties encountered in toroidal structures overwound with resin matrix fibre composite material.

According to the invention, a gas containment and supply apparatus comprises a gas reservoir vessel capable of pressurised gas containment fitted with a gas supply aperture, supply means connectable to the gas supply aperture at a first end to provide for supply of the gas through a second end, and control means to control the rate of supply of the gas, wherein the gas reservoir is a toroidal pressure vessel comprising a metallic toroidal shell having wound on the surface thereof a tensile load bearing layer of high tensile strength non-metallic fibre, the fibre being aligned in a substantially meridianal direction on the toroidal shell.

Both the fibre winding and the metal shell are intended to be load bearing. As with simple cylinders, these structures are subjected to significantly higher stresses in the meridianal direction than in the direction perpendicular to the meridian "ringwise" around the torus. The fibre is intended to bear a proportion of the meridianal load only, and is therefore wound in a substantially meridianal direction rather than diagonally round the torus as is the case for prior art composite layers such as described by UK Patent Application 2110566. The metal shell bears the remaining meridianal load and all the load perpendicular to the meridian. The use of winding to take part of the larger meridianal load allows the metal casing to be designed around lower loading parameters, and this produces a lighter vessel than would be possible using a metal construction alone.

The invention offers a compact pressurised gas reservoir which is lightweight and has a toroidal shape, both of which features result in enhanced portability. The toroidal geometry has a flatter profile since it has a smaller minor diameter than a cylinder of equal volume. The shape is thus particular suited to stowage where a flat profile is desired, or to carriage on the human back since it protrudes less behind the wearer in use. The toroidal shape is also advantageous for carriage on a human back as it fits back curvature more easily. The compact shape means that, although some form of harnessing to enable carriage of the tank by the operator will still be needed, this can generally be simpler, and hence lighter, than is needed for conventional cylindrical apparatus, and makes it possible to dispense with the back plate which is traditionally found necessary for at least the larger back mountable cylindrical gas bottles. The ability to dispense with the backplate is an additional factor in both the reduction of overall weight and the lessening of the distance behind the wearer by which the apparatus protrudes, both of which contribute to enhanced portability. The flatter profile of the torus shape also lends itself to being carried in a suitable bag or satchel which offers greater ease of portability whilst still providing the necessary mechanical constraint.

An additional advantage accruing from the toroidal shape lies in the ability for supply means connection to be made on the inside face of the torus affording some protection and reducing the possibility of its shearing off as a result of external impacts. For this purpose the supply aperture is preferably located on the inside face of the torus. The supply means may be permanently connected to the shell but for ease of storage and to allow replacement of gas vessels the gas supply aperture preferably includes means to effect releasable connection of the supply means and a closure valve to prevent release of gas with the supply means disconnected.

A particular advantage of using overwinding accrues from the build-up of thickness of the winding fibre on the inside of the torus. The overwinding is thus able to take a greater proportion of the meridianal load on the inside of the torus, which is the zone where the overall meridianal load is highest. This effect obviates the need for significant extra metal thickness in the higher loaded zones and as a consequence, a metal shell comprising a torus of substantially circular meridianal section and substantially uniform wall thickness gives close to optimum pressure containment performance with minimum redundant metal weight. Some simplification in manufacture results. However, it will be appreciated that a circular cross section is not essential to the effectiveness of the invention, and the invention can be applied to torus-shaped vessels of nonconstant curvature which have non-circular meridianal and/or transverse section where such a shape is more suited to the application of the invention.

Suitable materials for the winding include composites of polymeric, glass and carbon or ceramic fibres in a thermosetting or thermoplastic matrix. A thermosetting resin could be applied to the fibres as a prepreg prior to winding and cured after winding. A thermoplastic resin could be incorporated by using fine impregnated fibre bundles with sufficient flexibility to allow the winding operation, as thermoplastic fibres intermingled with the structural fibres, or as a thermoplastic powder attached to the structural fibres. Regardless of the method used to interlace the thermoplastic the composite will require subsequent consolidation under pressure at elevated temperature. In all cases the fibres are aligned around the meridian of the toroidal vessel.

However, since the invention employs fibres in the overwinding in a meridianal direction to carry loading in that direction only, it offers the additional possibility of dispensing with matrix altogether, or at least for the bulk of the load-bearing depth with only a surface layer applied for protection. In this matrix-free preferred aspect of the invention the absence of a matrix produces a weight saving compared with pressure vessels consisting of a shell overwound with a conventional fibre and matrix composite material and also obviates the requirement that the process must be compatible with consistent wetting of fibre matrix material during production, so that a simpler winding process can be used.

The starting point for fibre selection for this dry-wound matrix-free aspect of the invention is the group whose use will be familiar in thermosetting and thermoplastic resin matrix composite materials. The material used for the fibre winding requires high tensile strength. It must be a material which experiences little loss of strength through abrasion during winding or use and thus does not require matrix material for the abrasion resistance and protection it confers. Similarly, its strength must be only weakly dependent on fibre length (the so-called length/strength effect), so that the need for a matrix material to transfer load across broken filaments is minimal. These requirements tend to weigh against the use of glass fibres and carbon fibres in this aspect of the invention.

The above problems can be avoided by the use of high tensile strength organic polymeric fibres as such materials tend to be less susceptible to surface defects and exhibit a small length/strength dependence. Thus, they show a reduced tendency to lose strength as a result of abrasion damage. The role of the matrix in transferring load across broken filaments is therefore less important in composites employing this type of fibre. Thus, the tensile load bearing layer preferably comprises a layer of high tensile strength polymeric fibre, the fibre being aligned in a substantially meridianal direction on the toroidal shell and being free of any matrix material for at least a substantial part of its depth. Aramid fibres are particularly preferred for this purpose.

However, prestressed polymeric fibres tend to be susceptible to creep and stress relaxation, which can lead to them losing tension over service life and moving out of position. In conventional composites such movement is prevented by the presence of the matrix. For suitability in the present invention without a matrix the fibres must have creep and stress relaxation properties which are sufficiently low that the fibres can be practically pretensioned to a degree where they are able to retain sufficient tension over time to maintain position on the torus wall under all practical environmental exposure conditions.

Polymeric fibres also exhibit stress rupture; that is under a sufficiently high static load they will eventually fail. The time to such failure is dependent on stress and temperature and may be tens or hundreds of years. In relation to the present invention the stress rupture properties of the fibre must be such that the fibre tension arising from any necessary pretension in connection with overcoming creep problems together with the additional tension arising from the pressure loading can be accommodated without causing stress rupture failure for the lifetime of the vessel under all practical environmental exposure conditions.

There is thus a requirement that a "window" exists in the fibre properties in which sufficient initial pretension can be applied to the winding to avoid later movement arising from loss of tension due to creep without the pretension being so high as to cause stress rupture failure. The matrix-free winding in the preferred aspect of the invention exploits those high tensile strength polymeric fibres which have this window to dispense with the use of matrix material which the prior art requires as an essential feature of pressure vessels having a composite overwinding.

It has been found that aramid fibres possess such a window in their properties, and such fibres are therefore particularly suited to the matrix-free aspect of the invention. Carbon, glass and ceramic fibres possess larger windows, but their use is militated against by the problems outlined above in relation to abrasion resistance and the length/strength effect. Intermingled mixed fibres comprising one or more of these plus aramid, for example intermingled aramid and carbon fibres, offer a useful compromise. The aramid fibres shield the carbon from much of the abrasion that occurs during the winding process. During service, as stress relaxation and creep occur in the aramid fibres, load is gradually transferred to the carbon fibres. This is of value in designs in which the aramid fibre would be close to its stress rupture limit.

It is evident that the aperture in the toroidal shell cannot be overwound. For convenience of design the gas reservoir vessel may be provided with a zone of thickened inner casing without overwinding in the region of the gas supply aperture. However, a likely fabrication route for the toroidal shell is to weld together two curved gutters, and in such cases some structural problems can arise from intersecting welds where a thickened zone is welded into the vessel.

To overcome these difficulties an annular or partially-annular lug may be fitted over the aperture in the toroidal shell prior to overwinding, which lug comprises an external surface to receive a meridianally wound layer of fibre, a lateral aperture, and an air passage to provide a communication channel between the aperture in the toroidal shell and the lateral aperture. This configuration obviates the need to vary shell thickness in the vicinity of the gas supply aperture by allowing overwinding of fibre around essentially the entire surface of the toroidal shell.

The lug is preferably partially annular, with a crescent shaped section to minimise discontinuities at its edges. The lug is conveniently welded to the shell, preferably offset from the central plane of the torus to avoid intersection with the ringwise welds, which could give rise to potential weakness. External lubrication, for example with PTFE tape, is also desirable to avoid Kevlar fretting at the crescent tips.

An additional advantage of winding with a mixture of fibres is that by incorporating higher-modulus carbon fibres the stiffness of the winding can be increased, allowing the meridianal stiffness of the overwound zone (i.e. the product of Young's modulus and thickness) can be approximately matched to that of the non-overwound zone, reducing stresses which might be generated by discontinuities in stiffness.

The matrix-free overwinding is preferably covered with a protective coating. This serves to compensate in part for the absence of environmental protection conferred by the matrix in conventional fibre composite windings, and in particular to protect the fibre from visible and ultraviolet radiation which can adversely affect fibre strength (particularly where the overwinding uses the preferred aramid fibres), to keep moisture out of the winding, and to provide protection from abrasion. The coating may at its simplest take the form of a protective elastomeric layer applied over the wound fibre, perhaps as a paint. Alternatively, an impermeable coat is applied over the wound fibre, and a further layer of fibre is wound over the coat to which an appropriate compatible resin is applied. Thus the winding presents the external characteristics of a conventional resin matrix composite but the bulk characteristics of the winding, and hence its substantive mechanical properties, remain in accordance with the dry-wound, matrix-free preferred aspect of the invention with the attendant advantages detailed herein.

The fibre winding tension requires careful control to ensure that it is high enough to avoid the overwind becoming slack and vulnerable to slipping as stress relaxation and creep occur in the fibre over time but not so high as to induce stress rupture of the fibre. Furthermore, the winding may be overtensioned so as to apply a compressive prestress to the metal shell, and thereby the pressure at which yield of the shell takes place can be raised.

The winding tension is preferably varied during winding to produce even load distribution in the finished product. As multiple layers of winding are laid down the outer layers will apply some compressive load not only to the metal shell but also to the inner fibre layers. If a constant winding tension is maintained and the overwinding is deep enough this can result in the inner layers losing tension so that when they come under pressure loading in service they are unable to accept their full share of the load. The solution is to reduce the winding tension as winding proceeds, so that tensile loading is evenly distributed throughout all layers of the overwound fibre in the fully wound vessel. However, for thin-walled vessels the need to vary the winding tension may be of minor importance.

Use of overwinding in accordance with the invention allows selection of the failure mode, so that the more benign mode can be chosen for a given pressure vessel application. With an excess of fibre overwinding, failure will occur by hoopwise rupture, that is, via a meridianal crack caused by stress generated perpendicular to the meridian. With a deficiency of fibre overwinding, hoop failure will occur first, that is, a crack perpendicular to the meridian caused by meridianal stress. In the latter case, it is possible to impose a further selection by incorporating a variation in torus wall thickness to create a zone of weakness.

For the metal shell, the desire for reduced weight with strength leads to a preference for use of aluminium and its alloys or, most preferably, titanium and titanium alloys, although steel and other metals could be used, especially in less weight-critical applications of the invention.

To ensure consistent gas supply the control means preferably includes a pressure regulator which is preferably a two-stage regulator.

A particular application of the invention is in the field of breathing apparatus with the pressurised gas reservoir vessel serving as a breathing gas (oxygen, $O_2$/linert gas mix, air, etc.) vessel and a breathing mask and user operable demand valve connected to second end of the gas supply aperture. The toroidal shape is readily portable, and the design is compact and lightweight which are important considerations for this application of the invention. The protection offered by connecting the supply to a site on the inside of the ring is clearly of particular value in this embodiment of the invention.

BRIEF DESCRIPTION OF THE DRAWINGS

Embodiments of the invention will now be described by way of example only with reference to the accompanying drawings, in which.

DETAILED DISCUSSION OF PREFERRED EMBODIMENTS

Figure 1:
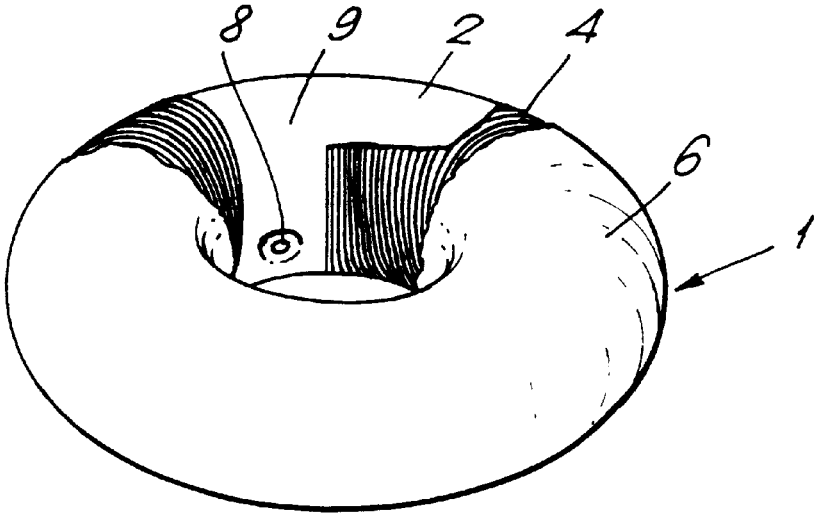
FIG. 1 is a perspective view of a pressurised gas reservoir vessel for breathing apparatus in accordance with the invention.

FIG. 1 illustrates a toroidal gas tank for a breathing apparatus according to the invention, provided with detachable supply apparatus and with the apparatus disconnected. A toroidal inner tank 2 having a nine litre capacity and a design pressure of 207 bar (21.1 Mpa) is fabricated from 6061 aluminium alloy, conveniently from two curved "gutters" welded together. The tank 2 is of circular meridianal and transverse section with a total diameter of 400 mm and an inner hole diameter of 128 mm. The tank 2 may, for example, be fabricated from two curved gutters welded together. The wall of the torus has a constant basic wall thickness of 6.5 mm. The tank 2 is overwound with Kevlar-49™ fibre 4 to an overwound layer thickness of 2.5 mm measured on the inside of the torus (this will correspond to a lesser thickness on the outside of the torus as a consequence of the build-up effect inherent in the toroidal geometry which was noted above), except for a small section of the casing 9 which is left without overwinding to enable the tapping in of a regulator connection 8. The overwinding technique is not pertinent to the invention, and the winding can be applied using standard apparatus and techniques for winding material onto a toroidal core which will be familiar to those skilled in the art, such as used for example in the manufacture of coil wound electrical items such as toroidal transformers and rheostats, with minor adaptation to accommodate the unwound region 9. The design is such that when the vessel is pressurized approximately half the meridianal load is borne by the overwinding 4, with the remaining meridianal load and all of the load perpendicular to the meridian being borne by the aluminium shell 2.

The fibre is provided with a covering for environmental protection consisting of an elastomeric polyurethane paint layer 6 applied over the wound fibre 4. FIG. 1 illustrates only part of the sleeve 6 with the remainder removed for better illustration of the underlying winding 4, but in use the sleeve 6 will extend over the whole of the overwinding.

Figure 2:
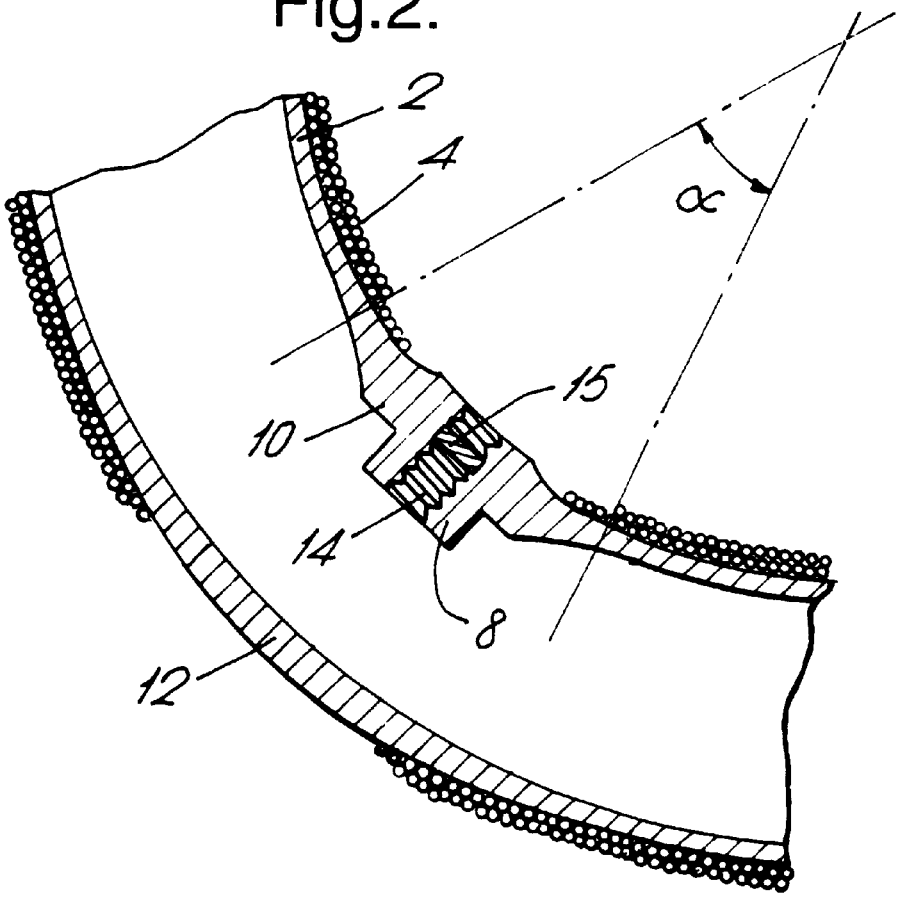
FIG. 2 is a transverse section of the vessel of FIG. 1 through the vicinity of the gas supply aperture.

The gas containment vessel requires a zone of thickened inner casing without overwinding 9 for tapping in the regulator connection 8. This is illustrated in FIG. 2 which is a transverse-section through the region in the vicinity of the regulator connection. Since the zone is not overwound, an optimal design will require the metal to be thicker on the inside 10 than on the outside 12 of the torus to accommodate the higher loadings experienced there as a consequence of the toroidal geometry. To accommodate this the wall thickness is increased from the basic 6.5 mm to around 10.5 mm on the outer wall 12 and 15 mm on the inner wall 14. The non-overwound zone needs to be as small as possible to reduce the excess weight it contributes to the pressure vessel, and in this case is restricted to an arc of the torus, $\alpha$, of 34°. As FIG. 2 illustrates, the transition is gradual in the transition zone to minimize the effect of discontinuities in stiffness arising from the relatively low stiffness of Kevlar™ which could give rise to additional stresses. As an alternative or additional feature the winding could incorporate stiffer carbon fibres with the Kevlar™ to match the meridinal stiffness in the wound and unwound zones more closely and reduce discontinuity stresses still further.

The regulator connection piece 8 is of standard M18 design, 25 mm long and provided with internal screw-threading 14 to facilitate connection of the regulator and associated breathing mouthpiece or facepiece and related apparatus, which is unconnected and is therefore not shown in the figure. With this apparatus unconnected the gas vessel is shown closed by the non-return valve 15. As an alternative an isolation valve could be used which screwed into the M18 threading 14. Siting the regulator connection 8 inside the ring of the torus offers more compact design and some degree of protection to the regulator once attached and in use.

Figure 3:
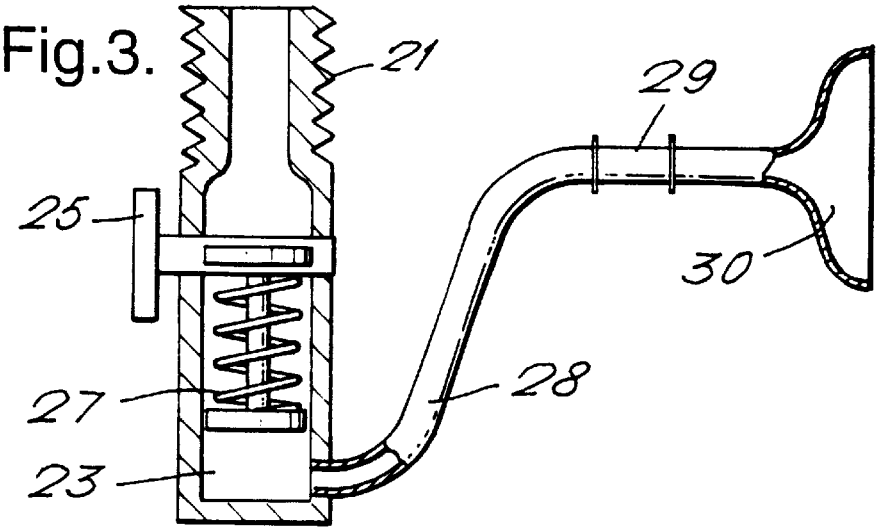
FIG. 3 is a cross section of a two stage regulator and facepiece for attachment to the gas supply aperture of FIGS. 1 and 2.

FIG. 3 illustrates in partial section a detachable regulator which is suitable for insertion into the gas tank of FIGS. 1 and 2 to reduce the pressure of the gas from its storage pressure to ambient. A screw threaded connector 21 compatible with the M18 connection piece 8 is provided to connect the regulator to the gas tank. Insertion of this piece opens the closure valve 15 in the tank, and supply to the regulator chamber 23 is then controlled by the rotatable control valve 25. The regulator is of the spring-loaded piston type 27. The gas then proceeds via a supply line 28 through a user operable demand valve 29 to a facepiece 30.

It will be understood that whilst a two-stage regulator is preferred the invention is applicable to gas tanks with non-removably connected breathing apparatus, whether or not incorporating a regulator.

Figure 4:
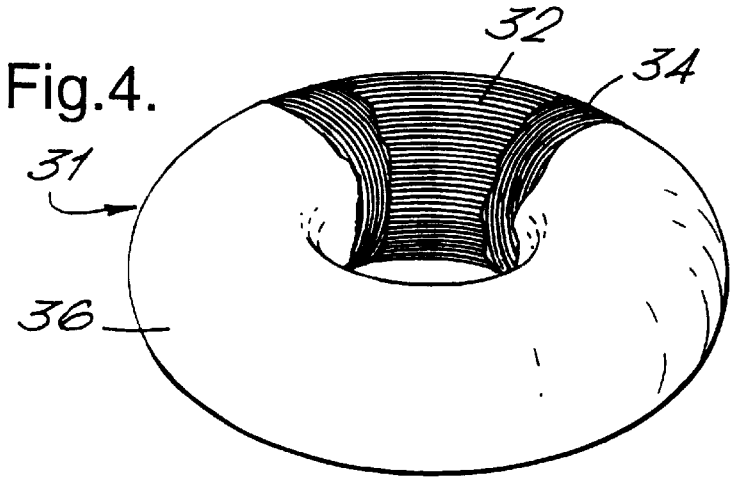
FIG. 4 is a perspective view of an alternative embodiment of pressurised gas reservoir vessel for breathing apparatus in accordance with the invention.

FIG. 4 illustrates an alternative embodiment of a pressure vessel in accordance with the invention. A toroidal inner tank 31 having similar external dimensions to the previous example is fabricated from a titanium alloy, Ti-6Al-4V. The tank is designed for a 6 litre capacity and operating pressure of 300 bar (31.65 MPa). The tank 31 is of circular meridianal and transverse section with a total diameter of 340 mm, an inner diameter of 112 mm, and a basic wall thickness of 3.2 mm.

Figure 5:
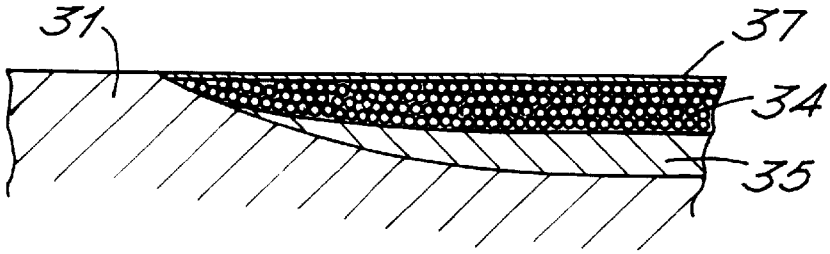
FIGS. 5*a* and 5*b* are sections of the vessel of FIG. 4 parallel to its axis and through the vicinity of the gas supply aperture showing tapered pre-preg and stepped pre-preg transition zones, respectively.
Figure 5:
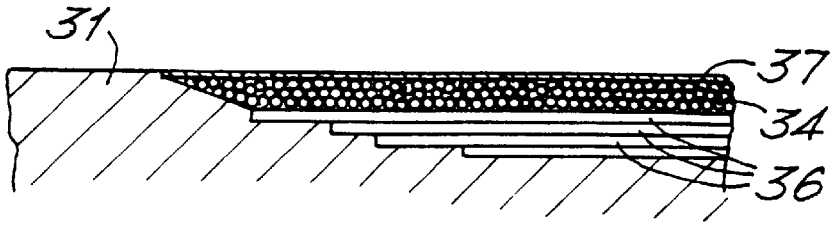
Figure 6:
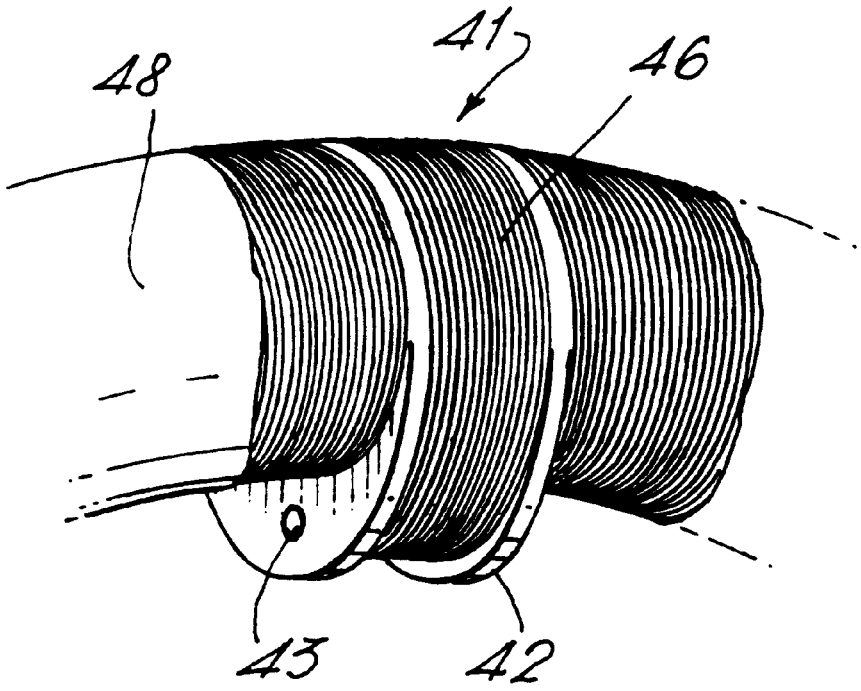
FIG. 6 is a perspective view of an alternative embodiment of gas supply aperture.
Figure 7:
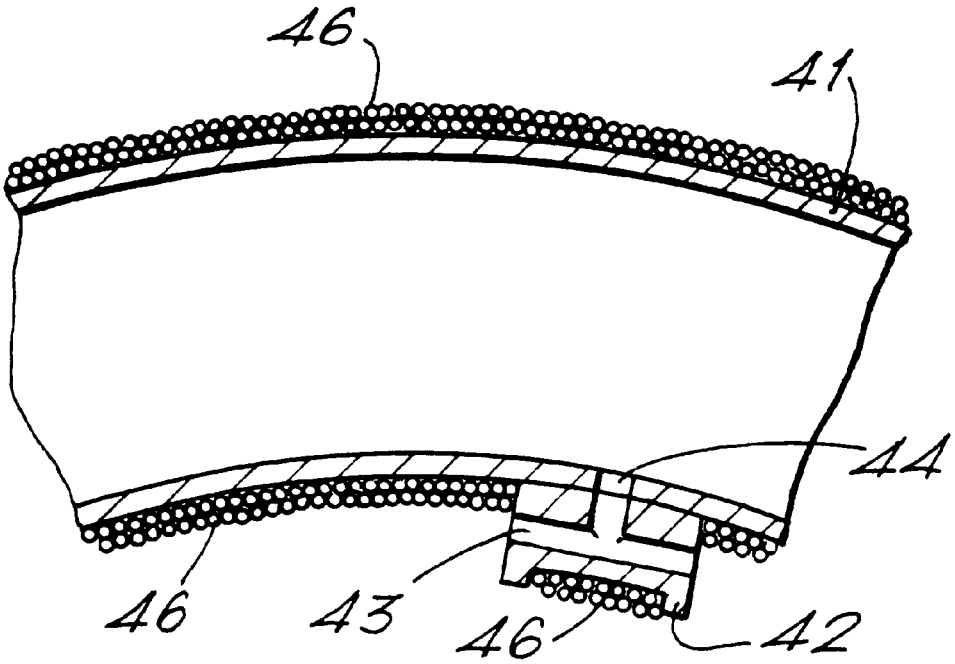
FIG. 7 is a transverse section of the vessel of FIG. 6 through the vicinity of the gas supply aperture.
Figure 8:
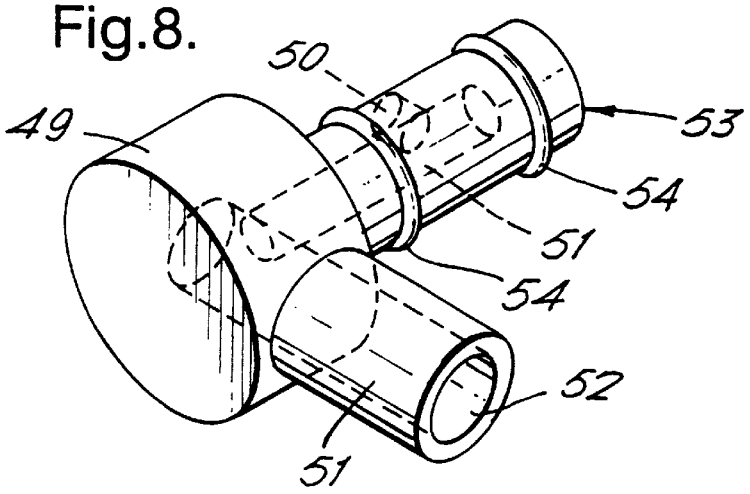
FIG. 8 is a perspective view of a connection adaptor suitable for use in conjunction with the gas supply aperture of FIGS. 6 and 7.

The tank first has applied to it a drapable carbon-fibre: epoxy prepreg. The prepreg is applied in strips laid onto the tank 31 in an alignment such that the fibres lie substantially perpendicular to the meridianal direction, thus forming, after standard consolidation and curing, an aligned composite layer 32 which carries some of the load in this direction. The tank is overwound with Kevlar-49™ fibre 34 in like manner to the previous example. As some of the ringwise load is carried by the carbon fibre composite layer 32 rather than the metal, considerable further weight savings are possible. Care is needed in the design to avoid stress concentrations where the layer 32 gives way to the thickened region and to ensure that the transition zone is sufficiently large to ensure effective load transfer into the composite layer 32. Two alternative approaches are illustrated in FIGS. 5*a* and 5*b*. In FIG. 5*a*, a tapered edge prepreg 35 is applied to the tank to give a tapered transition zone; and in FIG. 5*b* multiple layers of prepreg 36 are applied so as to give a stepped transition zone. An environmentally protective layer 37 is applied over the dry overwinding 34. However, it will be understood that the drapable prepreg concept is not an essential feature of either the overwound aluminium alloy design or the overwound titanium alloy design.

FIGS. 6 to 9 relate to an alternative embodiment of gas supply aperture.

A uniform wall thickness toroidal shell 41 is fabricated, probably from two curved "gutters" welded together. A lug 42 is welded onto the shell and is provided with air passages 43 which provide communication with an aperture 44 in the toroidal shell wall. The lug is preferably offset from the central plane of the torus to avoid intersection with the ringwise welds, which could give rise to potential weakness. However for operational reasons (e.g. the advantage of protection offered by locating connections on a site on the inside of the ring) it remains desirable not to move the pressure tapping too far from the "equator".

The tank is overwound with Kevlar-49™ fibre 46 in like manner to the previous examples, first as far as each side of the lug 42, and then, in a separate winding operation, on top of the lug. The tank is thus overwound for its full extent, obviating the need for incorporation of a thickened section in the vicinity of the gas supply aperture.

A surface coating 48 is applied as necessary to protect the fibre 46.

To make a connection to the gas regulator a banjo attachment 49 (illustrated in FIG. 8) is used. The projection 53 is inserted into the passage 43 in the lug 42 so that the hole 50 is aligned with the aperture 44 in the toroidal shell wall. Rubber ring seals 54 effect a gas tight connection and gas is able to pass via the passages 51 to the hole 52 which provides a regulator connection and is an M18 or other standard thread fitting design to facilitate connection of the regulator and associated breathing mouthpiece or facepiece and related apparatus (such as is illustrated in FIG. 3).

This embodiment eases the manufacture of the vessel and avoids the structural problems which can arise from intersecting welds where a thickened zone is welded into the vessel. The hole sizes are likely to be governed by the need to provide for insertion of an endoscope for internal inspection purposes rather than the size of air passage needed.

Figure 9:
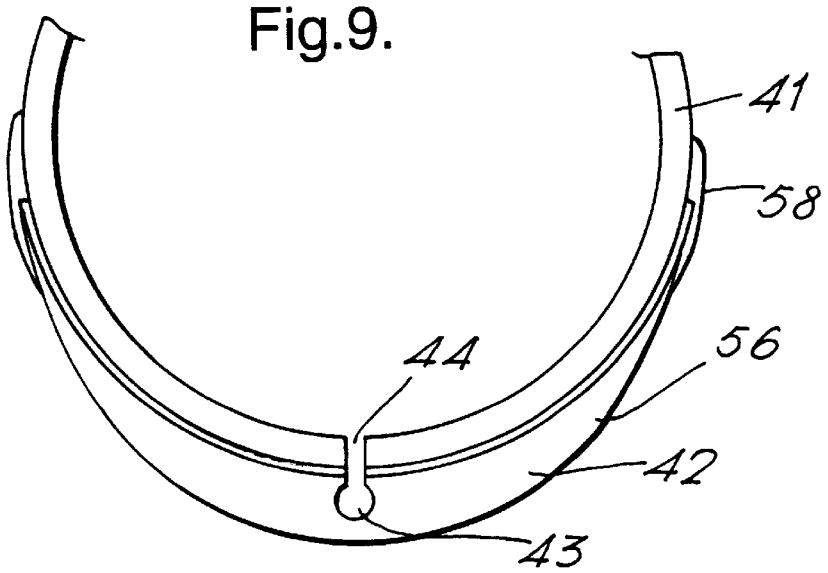
FIG. 9 is a meridianal section through the vicinity of the gas supply aperture of FIGS. 6 and 7.

FIG. 9 illustrates the preferred geometry for the lug 42 prior to application of the overwinding. For the overwind to function, it requires a positive curvature at all points so that it can exert inward pressure on the shell 41. Therefore the lug 42 needs to take the form of a long crescent shape, possibly with its external profile forming part of an ellipse. Most of the lug is loaded largely in compression and so can be a casting or plastic moulding. Therefore a complex shape presents no problems. The crescent may be made in one piece, or may be a separate item that attaches to a welded-on post.

As the crescent crosses the ringwise weld on the torus, it is not desirable that it should be continuously welded. Indeed a rigid welded-on item attached to a dilating shell would develop high stresses in the welds, a potential site for fatigue failure. However, if the crescent is not firmly attached at all points it may require "lubrication", for example using a layer of PTFE or nylon 56 to prevent it grating against the shell (thereby avoiding another possible source of fatigue failure). An alternative (not shown) is a series of spot welds with stress relief notches (which reduce the circumferential stiffness) built in, but this has the potential disadvantage of introducing more heat affected zones).

External lubrication, for example with PTFE tape, is also desirable to avoid Kevlar fretting at the crescent tips and is provided in this example by a layer of PTFE tape 58.

The remaining structural problem is that when designing pressure vessels of any type, it is desirable to arrange that initial failure occurs away from joints, lugs etc., but rather in the typical, uniform part of the vessel structure. In this way consistent and predictable burst pressures can be achieved. With the proposed design, an excess of Kevlar can be expected to suppress failure along the ringwise welds, in which case the likely failure mode would be a meridianal crack arising from the ringwise stress.

Unfortunately, as things stand the (small) hole in the torus surrounded by a weld and heat affected zone is the most probable site of initial failure.

A possible way around this would be to use a patch of metal or composite adhesively bonded to the inside surface of the torus. This would be designed to transfer enough load (perhaps 10–15% of the total) to suppress premature failure in the heat affected zone.

The manufacturing sequence described for the embodiment of FIGS. 6 to 9 would be modified to involve first the welding of a lug onto one of the "gutters". Then, a patch is applied to the inside of the gutter surface opposite the lug. The two gutters are welded together to form the torus and the windings applied as usual.

The size of the patch will be partly determined by the proximity to the ringwise weld and the temperature the adhesive will tolerate. There is a choice between an epoxy adhesive, good to about 170° C., or a bismaleide film adhesive (good to about 300° C. but not such an effective adhesive).

Figure 10:
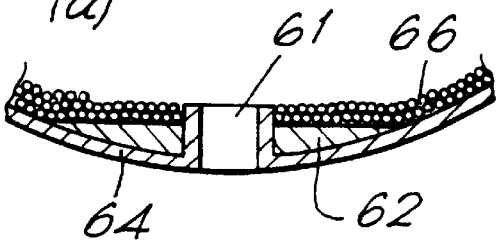
FIGS. 10*a* and 10*b* are a meridianal section through a load spreader plate reinforcement of the vicinity of the gas supply aperture.
Figure 10:
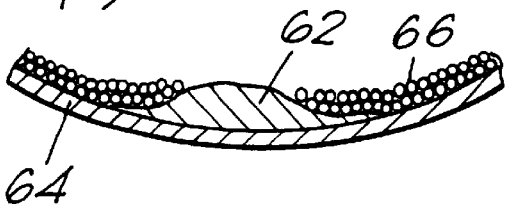

The post-crescent-banjo concept of FIGS. 6 to 9 has been developed as a means of allowing a pressure connection to be made and at the same time ensuring that the whole of the surface of the torus is supported by an overwrap. An alternative approach which is illustrated in FIG. 10 is to accept that there will be some unsupported areas and attempt to minimise their weakening effect.

The bare zone presents a problem in particular for thin shells of high strength metal. Local thickening of the shell is undesirable at it complicates manufacture and leads to stress concentrations and a possible source of fatigue failures (as one would expect with a stiff member rigidly attached to a dilating shell). The embodiments FIGS. 10*a* and 10*b* use a load spreader plate to bridge the bare zone, with FIG. 10*a* illustrating a section through the spreader plate at the inlet tube 61 and FIG. 10*b* a section away from inlet tube.

A plate 62 is provide which is curved to match the curvature of the toroidal shell 64, has a hole to fit over the inlet tube 61, and feathered edges. The plate provides extra support in the bare zone where overwinding 66 is absent. The plate should be loosely attached and free to slide on the torus as it dilates. A lubricating film may be used to assist this.

The plate will be subject to high shear and flexure loadings, and must be thick enough and of a suitable material to meet these. In general, fibre composites are not suited to taking out-of-plane shear loads. Isotropic metals would be preferred. To withstand fittings or connections. In this way the chances of obtaining consistent burst pressures characterised by a low coefficient of variation are enhanced.

When considering the overwound toroidal pressure vessel, with either the post-crescent-banjo design of FIG. 6 to 9 or the load spreading plate of FIG. 10, one would expect first failure to occur principally under the action of the ringwise loads (the design is intended to employ an excess of overwind to suppress failure due to the meridianal load). The expected failure would take the form of a meridianal crack running round the minor circumference of the torus. In the ringwise direction the weakest area can be expected to be in the region of the weld and/or heat affected zone around the pressure inlet, i.e. either the post or inlet tube.

To avoid this failure by local thickening is undesirable for the reasons discussed above. The load spreading plate does nothing to take the membrane loads that lead to failure.

A possible solution is to use a thin patch of material bonded to the torus surface around the weld. CFRP is ideal for this and the technology for applying such patches is well established from SMCs work on composite repairs. As the strength loss around the welds is not expected to be large, the thickness of material needed can be quite small, perhaps no more than 0.5 mm. The mass penalty would be minimal.

The reinforcing patch concept is applicable to either the post-crescent concept of FIGS. 6 to 9 or the load spreading plate of FIG. 10. In the former case the additional thickness would present a minor problem in an area where space is at a premium. In the latter case the patch would need to operate under the spreader plate and would thus need sufficient through-thickness compressive strength to withstand the compressive loads.

What is claimed is:

1. A gas containment and supply apparatus comprising:

a gas reservoir vessel capable of pressurized gas containment fitted with a gas supply aperture, supply means connectable to the gas supply aperture at a first end to provide for supply of the gas through a second end, and control means to control the rate of supply of the gas, wherein the gas reservoir vessel is a toroidal pressure vessel comprising a metallic toroidal shell having wound on the surface thereof a tensile load bearing layer of high tensile strength polymeric fibre, the fibre being aligned in a substantially meridianal direction on the toroidal shell and being free of any matrix material for at least a substantial part of its winding depth.

2. An apparatus as claimed in claim 1 wherein the supply aperture is located on the inside face of the torus.

3. An apparatus as claimed in claim 2, wherein said gas supply aperture is located at about the equator of said toroidal shell.

4. An apparatus as claimed in claim 1 wherein the gas supply aperture includes means to effect releasable connection of the supply means and a closure valve to prevent release of gas with the supply means disconnected.

5. An apparatus as claimed in claim 1 wherein the shell comprises a torus of substantially circular meridianal section and substantially uniform wall thickness.

6. An apparatus as claimed in claim 1 wherein the fibre comprises an aramid.

7. An apparatus as claimed in claim 6 wherein the tensile load bearing layer is of intermingled mixed fibres comprising aramid fibre in combination with at least one of carbon, glass or ceramic fibres.

8. An apparatus as claimed in claim 1 wherein the fibre winding is overtensioned so as to apply a compressive prestress to the metal shell.

9. An apparatus as claimed in claim 1 wherein the shell is manufactured from material selected from the group comprising aluminium and alloys thereof and titanium and alloys thereof.

10. An apparatus as claimed in claim 1 wherein the gas reservoir vessel is provided with a zone of thickened inner casing without overwinding in the region of the gas supply aperture.

11. An apparatus as claimed in claim 1 wherein an at least partially-annular lug is fitted over the aperture in the toroidal shell below the overwinding, which lug comprises an external surface to receive a meridianally wound layer of fibre, a lateral aperture, and an air passage to provide a communication channel between the aperture in the toroidal shell and the lateral aperture.

12. An apparatus according to claim 11 wherein the lug is partially annular with a crescent shaped section.

13. An apparatus as claimed in claim 1 in which the control means includes a pressure regulator.

14. A breathing apparatus comprising a human portable gas containment and supply apparatus as claimed in claim 1 in which the pressurized gas reservoir serves as a breathing gas reservoir and further comprising a breathing facepiece and user operable demand valve connected to the second end of the gas supply aperture.

15. An apparatus as claimed in claim 1, wherein said as supply aperture comprises a spreader plate.

16. A gas containment and supply apparatus comprising:

a gas reservoir vessel capable of pressurized gas containment, wherein the gas reservoir vessel is a toroidal pressure vessel comprising a metallic toroidal shell having wound on the surface thereof a tensile load bearing layer of high tensile strength polymeric fibre, the fibre being aligned in a substantially meridianal direction on the toroidal shell and being free of any matrix material for at least a substantial part of its winding depth.

17. An apparatus as claimed in claim 16 wherein the shell comprises a torus of substantially circular meridianal section and substantially uniform wall thickness.

18. An apparatus as claimed in claim 17 wherein the fibre comprises an aramid.

19. An apparatus as claimed in claim 18 wherein the tensile load bearing layer is of intermingled mixed fibres comprising aramid fibre in combination with at least one of carbon, glass or ceramic fibres.

20. An apparatus as claimed in claim 16 wherein the fibre winding is overtensioned so as to apply a compressive prestress to the metal shell.

21. An apparatus as claimed in claim 16 wherein the shell is manufactured from material selected from the group comprising aluminium and alloys thereof and titanium and alloys thereof.

22. An apparatus as claimed in claim 16 wherein the gas reservoir vessel is provided with a zone of thickened inner casing without overwinding in the region of the gas supply aperture.

23. An apparatus as claimed in claim 16 wherein an at least partially-annular lug is fitted over the aperture in the toroidal shell below the overwinding, which lug comprises an external surface to receive a meridianally wound layer of fibre, a lateral aperture, and an air passage to provide a communication channel between the aperture in the toroidal shell and the lateral aperture.

24. An apparatus as claimed in claim 23 wherein the lug is partially annular with a crescent shaped section.

25. An apparatus as claimed in claim 16, further including a pressure regulator.

26. A breathing apparatus comprising a human portable gas containment and supply apparatus as claimed in claim 16 in which the pressurized gas reservoir serves as a breathing gas reservoir and further comprising a breathing facepiece and user operable demand valve connected to one end of a supply line and the other end of the supply line is connected to a gas supply aperture in said vessel.

27. An apparatus as claimed in claim 16, wherein said layer of fiber includes a protective coating.

28. A gas containment and supply apparatus comprising:

a gas reservoir vessel capable of pressurized gas containment fitted with a gas supply aperture, gas supply line connectable to the gas supply aperture at a first end to provide for supply of the gas through a second end, and a regulator controlling the rate of supply of the gas through said gas supply line wherein the gas reservoir vessel is a toroidal pressure vessel comprising a metallic toroidal shell having wound on the surface thereof a Tensile load bearing layer of high tensile strength polymeric fibre, the fibre being aligned in a substantially meridianal direction on the toroidal shell and being free of any matrix material for at least a substantial part of its winding depth.

* * * * *